US007037464B2

(12) United States Patent
Ohtsuka et al.

(10) Patent No.: US 7,037,464 B2
(45) Date of Patent: May 2, 2006

(54) DISPERSED OXIDE REINFORCED MARTENSITIC STEEL EXCELLENT IN HIGH TEMPERATURE STRENGTH AND METHOD FOR PRODUCTION THEREOF

(75) Inventors: Satoshi Ohtsuka, Higashi-Ibaraki-gun (JP); Shigeharu Ukai, Higashi-Ibaraki-gun (JP); Takeji Kaito, Higashi-Ibaraki-gun (JP); Takeshi Narita, Higashi-Ibaraki-gun (JP); Masayuki Fujiwara, Kobe (JP)

(73) Assignee: Japan Nuclear Cycle Development Institute, Ibaraki (JP)

( * ) Notice: Subject to any disclaimer, the term of this patent is extended or adjusted under 35 U.S.C. 154(b) by 0 days.

(21) Appl. No.: 10/502,257

(22) PCT Filed: Aug. 7, 2003

(86) PCT No.: PCT/JP03/10081

§ 371 (c)(1),
(2), (4) Date: Jul. 23, 2004

(87) PCT Pub. No.: WO2004/015154

PCT Pub. Date: Feb. 19, 2004

(65) Prior Publication Data

US 2005/0084405 A1 Apr. 21, 2005

(30) Foreign Application Priority Data

Aug. 8, 2002 (JP) ..... 2002-231780
Jul. 18, 2003 (JP) ..... 2003-276554

(51) Int. Cl.
*C22C 1/05* (2006.01)
*C22C 33/02* (2006.01)

(52) U.S. Cl. ..... 419/19; 419/29; 419/32; 419/33; 419/48

(58) Field of Classification Search ..... 75/235, 75/246; 419/19, 32, 29, 33, 48
See application file for complete search history.

(56) References Cited

U.S. PATENT DOCUMENTS

| | | | | |
|---|---|---|---|---|
| 4,963,200 | A | 10/1990 | Okuda et al. | |
| 5,167,728 | A * | 12/1992 | Weber | 148/514 |
| 5,209,772 | A * | 5/1993 | Benn et al. | 75/233 |
| 5,427,600 | A * | 6/1995 | Itoh et al. | 75/232 |
| 6,485,584 | B1 * | 11/2002 | Lambard et al. | 148/514 |
| 6,827,755 | B1 * | 12/2004 | Taguchi et al. | 75/236 |

FOREIGN PATENT DOCUMENTS

| | | |
|---|---|---|
| EP | 0 949 346 | 10/1999 |
| JP | 5-18897 | 3/1993 |

* cited by examiner

*Primary Examiner*—Ngoclan T. Mai
(74) *Attorney, Agent, or Firm*—Wenderoth, Lind & Ponack, L.L.P.

(57) ABSTRACT

In an oxide dispersion strengthened martensitic steel which comprises, by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, by adjusting the Ti content within the range of 0.1 to 1.0% so that an excess oxygen content Ex.O in steel satisfies [0.22×Ti (% by weight)<Ex.O (% by weight)<0.46×Ti (% by weight)], the oxide particles are finely dispersed and highly densified to thereby obtain an oxide dispersion strengthened martensitic steel excellent in high-temperature strength. It is also possible to reduce the amount of oxygen contamination in steel during the mechanical alloying of raw material powders to provide Ex.O within a predetermined range, by carrying out the mechanical alloying in an Ar atmosphere having a super purity of not less than 99.9999%, by reducing stirring energy during the mechanical alloying or by using a metal Y powder or an $Fe_2Y$ powder in place of the $Y_2O_3$ powder.

5 Claims, 9 Drawing Sheets

MM11

T14

MM13

T3

T4

T5

DISPERSED OXIDE REINFORCED MARTENSITIC STEEL EXCELLENT IN HIGH TEMPERATURE STRENGTH AND METHOD FOR PRODUCTION THEREOF

TECHNICAL FIELD

The present invention relates to an oxide dispersion strengthened (ODS) martensitic steel excellent in high-temperature strength and a method of manufacturing this steel.

The oxide dispersion strengthened martensitic steel of the present invention can be advantageously used as a fuel cladding tube material of a fast breeder reactor, a first wall material of a nuclear fusion reactor, a material for thermal power generation, etc. in which excellent high-temperature strength and creep strength are required.

BACKGROUND ART

Although austenitic stainless steels have hitherto been used in the component members of nuclear reactors, especially fast reactors which are required to have excellent high-temperature strength and resistance to neutron irradiation, they have limitations on irradiation resistance such as swelling resistance. On the other hand, martensitic stainless steels have the disadvantage of low high-temperature strength although they are excellent in irradiation resistance.

Therefore, oxide dispersion strengthened martensitic steels have been developed as materials that combine irradiation resistance and high-temperature strength and there have been proposed techniques for improving high-temperature strength by adding Ti to oxide dispersion strengthened martensitic steels, thereby finely dispersing oxide particles.

For example, Japanese Patent Laid-Open No. 5-18897/1993 discloses a tempered oxide dispersion strengthened martensitic steel which comprises, as expressed by % by weight, 0.05 to 0.25% C, not more than 0.1% Si, not more than 0.1% Mn, 8 to 12% Cr (12% being excluded), 0.1 to 4.0% in total of Mo+W, not more than 0.01% O (O in $Y_2O_3$ and $TiO_2$ being excluded) with the balance being Fe and unavoidable impurities, and in which complex oxide particles comprising $Y_2O_3$ and $TiO_2$ having an average particle diameter of not more than 1000 Å are homogeneously dispersed in the matrix in an amount of 0.1 to 1.0% in total of $Y_2O_3$+$TiO_2$ and in the range of 0.5 to 2.0 of the molecular ratio $TiO_2/Y_2O_3$.

However, even when oxide dispersion strengthened martensitic steels are produced by adjusting the total amount of $Y_2O_3$ and $TiO_2$ and the ratio of these oxides and besides the total amount of Mo and W as disclosed in the Japanese Patent Laid-Open No. 5-18997/1993, there are cases where oxide particles are not finely dispersed in a homogeneous manner and it follows that in such cases the expected effect on an improvement in high-temperature strength cannot be achieved.

DISCLOSURE OF THE INVENTION

An object of the present invention is, therefore, to provide an oxide dispersion strengthened martensitic steel in which oxide particles are finely and homogeneously dispersed at a high density is positively obtained, with the result that excellent high-temperature strength is obtained, and to provide a method of manufacturing this steel.

Paying attention to the fact that an excess oxygen content Ex.O (a value obtained by subtracting an oxygen content in $Y_2O_3$ from an oxygen content in steel) in an oxide dispersion strengthened martensitic steel has a close relation to high-temperature strength, the present inventors have found that high-temperature strength can be positively improved by adjusting the level of the excess oxygen content in steel within a predetermined range, thus having accomplished the present invention.

According to the present invention, there is provided an oxide dispersion strengthened martensitic steel excellent in high-temperature strength which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, characterized in that the oxide particles are finely dispersed and highly densified by adjusting the Ti content within the range of 0.1 to 1.0% so that an excess oxygen content Ex.O in the steel satisfies [0.22×Ti (% by weight)<Ex.O (% by weight)<0.46×Ti (% by weight)].

Incidentally, in the following descriptions of this specification, "%" denotes "% by weight" unless otherwise noted.

In the present invention, by adjusting the Ti content in steel within the range of 0.1 to 1.0% so that the excess oxygen content Ex.O in steel becomes a predetermined range, it becomes possible to finely disperse oxide particles in steel and increase the density of them at a high level, with the result that it becomes possible to improve the high-temperature short-time strength and high-temperature long-time strength of the steel.

The steel of the invention described above can be manufactured by subjecting either element powders or alloy powders and a $Y_2O_3$ powder to mechanical alloying treatment in an Ar atmosphere. In this manufacturing process, by reducing the amount of oxygen which is included in the steel, it is also possible to keep the excess oxygen content in the resulting steel in a predetermined range.

Accordingly, the present invention provides a method of manufacturing an oxide dispersion strengthened martensitic steel excellent in high-temperature strength, the method comprising subjecting either element powders or alloy powders and a $Y_2O_3$ powder to mechanical alloying treatment in an Ar atmosphere to manufacture an oxide dispersion strengthened martensitic steel which comprises 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, characterized in that an Ar gas having a purity of not less than 99.9999% is used as the Ar atmosphere so that an excess oxygen content Ex.O in the steel satisfies [0.22×Ti (% by weight)<Ex.O (% by weight)<0.46×Ti (% by weight)].

The present invention further provides a method of manufacturing an oxide dispersion strengthened martensitic steel excellent in high-temperature strength, the method comprising subjecting either element powders or alloy powders and a $Y_2O_3$ powder to mechanical alloying treatment in an Ar atmosphere to manufacture an oxide dispersion strengthened martensitic steel which comprises 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, characterized in that a stirring energy during the mechanical alloying treatment decreases to suppress oxygen contamination during stirring so that an excess oxygen content Ex.O in the steel satisfies [0.22×Ti (% by weight)<Ex.O (% by weight) <0.46×Ti (% by weight)].

The present invention further provides a method of manufacturing an oxide dispersion strengthened martensitic steel excellent in high-temperature strength, the method comprising subjecting either element powders or alloy powders and a $Y_2O_3$ powder to mechanical alloying treatment in an Ar atmosphere to manufacture an oxide dispersion strengthened martensitic steel which comprises 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, characterized in that a metal Y powder or a $Fe_2Y$ powder is used in place of the $Y_2O_3$ powder so that an excess oxygen content Ex.O in the steel satisfies [0.22×Ti (% by weight)<Ex.O (% by weight)<0.46×Ti (% by weight)].

BEST MODE FOR CARRYING OUT THE INVENTION

Figure 1:
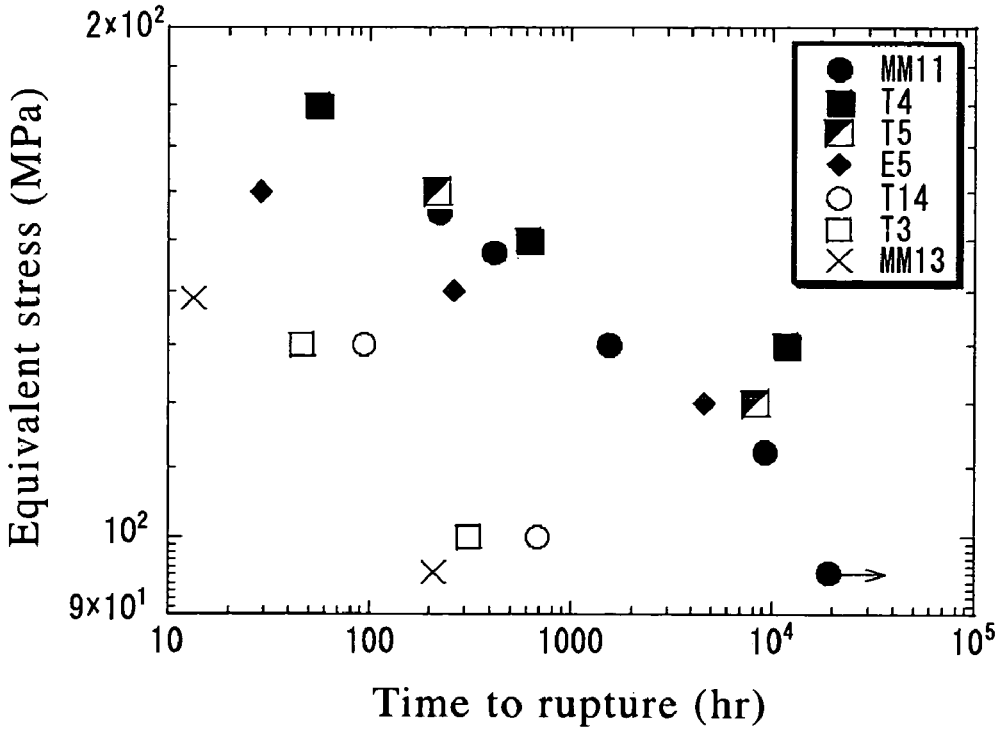
FIG. 1 is a graph showing the results of a creep rupture test at 700° C. of various test materials.

The chemical composition of the oxide dispersion strengthened martensitic steel of the present invention and the reasons for the limitation of its components will be described below.

Cr (chromium) is an element important for ensuring corrosion resistance, and if the Cr content is less than 8.0%, the worsening of corrosion resistance becomes remarkable. If the Cr content exceeds 12.0%, a decrease in toughness and ductility is feared. For this reason, the Cr content should be 8.0 to 12.0%.

When the Cr content is 8.0 to 12.0%, it is necessary that C (carbon) be contained in an amount of not less than 0.05% in order to make the structure a stable martensite structure. This martensite structure is obtained by conducting heat treatment including normalizing at 1000 to 1150° C.+tempering at 700 to 800° C. The higher the C content, the amount of precipitated carbides ($M_{23}C_6$, $M_6C$, etc.) and high-temperature strength increases. However, workability deteriorates if C is contained in an amount exceeding 0.25%. For this reason, the C content should be 0.05 to 0.25%.

W (tungsten) is an important element which dissolves into an alloy in a solid solution state to improve high-temperature strength, and is added in an amount of not less than 0.1%. A high W content improves creep rupture strength due to the solid solution strengthening, the strengthening by carbide ($M_{23}C_6$, $M_6C$, etc.) precipitation and the strengthening by intermetallic compound precipitation. However, if the W content exceeds 4.0%, the amount of δ-ferrite increases and contrarily strength decreases. For this reason, the W content should be 0.1 to 4.0%.

Ti (titanium) plays an important role in the dispersion strengthening of $Y_2O_3$ and forms the complex oxide $Y_2Ti_2O_7$ or $Y_2TiO_5$ by reacting with $Y_2O_3$, thereby functioning to finely disperse oxide particles. This action tends to reach a level of saturation when the Ti content exceeds 1.0%, and the finely dispersing action is small when the Ti content is less than 0.1%. For this reason, the Ti content should be 0.1 to 1.0%.

$Y_2O_3$ is an important additive which improves high-temperature strength due to dispersion strengthening. When the $Y_2O_3$ content is less than 0.1%, the effect of dispersion strengthening is small and strength is low. On the other hand, when $Y_2O_3$ is contained in an amount exceeding 0.5%, hardening occurs remarkably and a problem arises in workability. For this reason, the $Y_2O_3$ content should be 0.1 to 0.5%.

A method described below may be used as a general manufacturing method of the oxide dispersion strengthened martensitic steel of the present invention. The above-described components as either element powders or alloy powders and a $Y_2O_3$ powder are mixed so as to obtain a target composition. The resulting powder mixture is subjected to mechanical alloying treatment which comprises charging the powder mixture into a high-energy attritor and stirring the powder mixture in an Ar atmosphere. Thereafter, the resulting alloyed powder is filled in a capsule made of a mild steel. The capsule is then degassed and sealed, and hot extrusion is carried out after heating it to 1150° C. to thereby solidify the alloyed powder.

In this manufacturing process, an Ar gas having a purity of 99.99% is usually used as the atmosphere gas during the mechanical alloying treatment. However, even when such a high-purity Ar gas is used, it is impossible to avoid the oxygen contamination into steel, though slight in quantity. In the present invention, by using a high purity Ar gas of not less than 99.9999%, it is possible to reduce the oxygen contamination into steel, with the result that it is possible to adjust the excess oxygen content in the resulting steel within a predetermined range.

Furthermore, in carrying out the mechanical alloying treatment by charging the raw material powder mixture into the high-energy attritor and stirring the powder mixture, by decreasing the stirring energy in the attritor and suppressing the amount of entrapped oxygen during the stirring, it is also possible to reduce the excess oxygen content in steel and to adjust the excess oxygen content in the resulting steel within a predetermined range. As specific means of decreasing the stirring energy, it is considered to lower the rotary speed of an agitator of the attritor, to shorten the length of a pin attached to the agitator, and the like.

Moreover, in the step of mixing either element powders or alloy powders and a $Y_2O_3$ powder to prepare a target composition, a metal Y powder or an $Fe_2Y$ powder is used as a raw material powder in place of the $Y_2O_3$ powder. By using such a metal Y powder or an $Fe_2Y$ powder, the Y metal reacts with the oxygen which is contaminated during the manufacturing process such as the mechanical alloying treatment or with the oxygen from mixed unstable oxides ($Fe_2O_3$ etc.), to thereby form thermodynamically stable dispersed $Y_2O_3$ particles. As a result, it is possible to effectively adjust the excess oxygen content in steel to a predetermined range. Incidentally, the excess oxygen content in steel in this case is calculated on the assumption that the whole amount of the added metal Y becomes $Y_2O_3$.

TEST EXAMPLE

Table 1 collectively shows the target compositions of test materials of oxide dispersion strengthened martensitic steel, features of the compositions, and manufacturing conditions.

TABLE 1

| Test material No. | Target composition | Features of compositions | Manufacturing conditions |
|---|---|---|---|
| MM11 | 0.13C—9Cr—2W—0.20Ti—0.35$Y_2O_3$ | Basic composition | Stirring energy: Small<br>Atmosphere: 99.99% Ar |
| MM13 | 0.13C—9Cr—2W—0.20Ti—0.35$Y_2O_3$ | Basic composition | Stirring energy: Large<br>Atmosphere: 99.99% Ar |
| T14 | 0.13C—9Cr—2W—0.20Ti—0.35$Y_2O_3$ | Basic composition | Stirring energy: Large<br>Atmosphere: 99.99% Ar |
| T3 | 0.13C—9Cr—2W—0.20Ti—0.35$Y_2O_3$—0.17$Fe_2O_3$ | Addition of unstable oxide ($Fe_2O_3$) | Stirring energy: Large<br>Atmosphere: 99.99% Ar |
| T4 | 0.13C—9Cr—2W—0.50Ti—0.35$Y_2O_3$ | Increase of Ti | Stirring energy: Large<br>Atmosphere: 99.99% Ar |
| T5 | 0.13C—9Cr—2W—0.50Ti—0.35$Y_2O_3$—0.33$Fe_2O_3$ | Increase of Ti<br>Addition of unstable oxide ($Fe_2O_3$) | Stirring energy: Large<br>Atmosphere: 99.99% Ar |
| E5 | 0.13C—9Cr—2W—0.20Ti—0.35$Y_2O_3$ | Basic composition | Stirring energy: Large<br>Atmosphere: 99.9999% Ar |

In each test material, either element powders or alloy powders and a $Y_2O_3$ powder were blended to obtain a target composition, charged into a high-energy attritor and thereafter subjected to mechanical alloying treatment by stirring in an Ar atmosphere. The number of revolutions of the attritor was about 220 revolutions per minute (rpm) and the stirring time was about 48 hours. The resulting alloyed powder was filled in a capsule made of a mild steel, degassed at a high temperature in a vacuum, and then subjected to hot extrusion at about 1150 to 1200° C. in an extrusion ratio of 7 to 8:1, to thereby obtain a hot extruded rod-shaped material.

In each of the test materials shown in Table 1, not only a $Y_2O_3$ powder but also Ti was added to try to finely disperse and highly densify dispersed oxide particles by the formation of complex oxides of Ti and Y. The test materials MM11, MM13, T14 and E5 have a basic composition. T3 is a test material in which the excess oxygen content was intentionally increased by adding an unstable oxide ($Fe_2O_3$) to the basic composition of MM13 and T14. T4 is a test material in which the amount of added Ti was increased by adding higher amount of Ti powder to the basic composition of M13 and T14. T5 is a test material in which the excess oxygen content was increased by adding an unstable oxide ($Fe_2O_3$) and the amount of added Ti was also increased.

"Stirring energy" in the manufacturing conditions (mechanical alloying treatment conditions) of Table 1 shows the difference in the length of the pin attached to the agitator of the attritor which stirs the raw material powders during the mechanical alloying treatment. "Stirring energy: Large" means the use of the pin having a normal length, and "Stirring energy: Small" means the use of the pin having a length shorter than normal. That is, even when the number of revolutions of the agitator is the same, the stirring energy is smaller in the case of the shorter pin than in the case of the pin having a normal length and hence the amount of entrapped oxygen is reduced during the stirring. For only MM11 in Table 1, an agitator which has the shorter pin and in which the stirring energy is small was used. In all other test materials, an agitator which has the pin of normal length and in which the stirring energy is large was used. For the Ar atmosphere, a super high purity Ar gas having a purity of 99.9999% was used in only E5 in Table 1 and a high purity Ar gas having a purity of 99.99% was used in all other test materials.

Table 2 collectively shows the results of chemical analysis of each test material which was prepared as described above.

TABLE 2

| Classification | Chemical compositions (wt %) | | | | | | | | | | | | | | |
|---|---|---|---|---|---|---|---|---|---|---|---|---|---|---|---|
| | C | Si | Mn | P | S | Ni | Cr | W | Ti | Y | O | N | Ar | $Y_2O_3$ | Ex. O |
| Target range of basic composition | 0.11~0.15 | <0.20 | <0.20 | <0.02 | <0.02 | <0.20 | 8.5~9.5 | 1.8~2.2 | 0.18~0.22 | 0.26~0.29 | 0.15~0.25 | <0.07 | <0.007 | | |
| Target value | 0.13 | — | — | — | — | — | 9.00 | 2.00 | 0.20 | 0.275 | 0.20 | — | — | | |
| MM11 | 0.14 | <0.01 | <0.01 | 0.002 | 0.003 | <0.01 | 9.00 | 1.92 | 0.20 | 0.28 | 0.15 | 0.009 | 0.003 | 0.36 | 0.07 |
| MM13 | 0.14 | <0.005 | <0.01 | 0.001 | 0.003 | 0.01 | 8.80 | 1.95 | 0.21 | 0.27 | 0.21 | 0.009 | 0.005 | 0.343 | 0.137 |
| T14 | 0.14 | <0.005 | <0.01 | 0.002 | 0.003 | 0.04 | 8.80 | 1.96 | 0.21 | 0.26 | 0.18 | 0.013 | 0.005 | 0.330 | 0.110 |
| T3 | 0.13 | <0.005 | <0.01 | 0.002 | 0.003 | 0.01 | 8.75 | 1.93 | 0.21 | 0.27 | 0.22 | 0.012 | 0.005 | 0.343 | 0.147 |
| T4 | 0.13 | <0.005 | <0.01 | 0.002 | 0.003 | 0.01 | 8.72 | 1.93 | 0.46 | 0.27 | 0.18 | 0.009 | 0.005 | 0.343 | 0.107 |
| T5 | 0.13 | <0.005 | <0.01 | 0.002 | 0.003 | 0.01 | 8.75 | 1.93 | 0.46 | 0.27 | 0.24 | 0.011 | 0.005 | 0.343 | 0.167 |
| E5 | 0.13 | <0.005 | <0.01 | <0.005 | 0.002 | 0.01 | 8.89 | 1.97 | 0.21 | 0.28 | 0.16 | 0.009 | 0.005 | 0.356 | 0.084 |

<Creep Rupture Test>

Among the hot extruded rod-shaped materials obtained above, T14, T3, T4, T5 and E5 were subjected to final heat treatment involving normalizing (1050° C.×1 hr, air cooling)+tempering (800° C.×1 hr, air cooling) and finished as rod-shaped materials. MM11 and MM13 were first formed in tubular shape and then subjected to final heat treatment involving normalizing (1050° C.×1 hr, air cooling)+tempering (800° C.×1 hr, air cooling). The tube making process was carried out by the first cold rolling+heat treatment for softening →the second cold rolling+heat treatment for softening→the third cold rolling+heat treatment for softening→the fourth cold rolling+final heat treatment.

For rod-shaped test pieces (T14, T3, T4, T5, E5) and tubular test pieces (MM11, MM13) thus obtained, a creep rupture test at 700° C. was conducted. The results of the test are shown in the graph shown in FIG. 1. For the rod like test pieces (T14, T3, T4, T5, E5), a gauge portion of 6 mm diameter×30 mm length was worked for the test. From this graph, it is understood that the creep rupture strength of each of the test materials MM11, T4, T5 and E5 is superior to that of other test materials. Since an oxide dispersion strengthened martensitic steel has an equiaxed grain structure and does not have anisotropy in strength, a comparison between tubular test pieces and rod like test pieces is possible.

Incidentally, the arrow in the graph shown in FIG. 1 indicates that a rupture did not occur after a lapse of the test time and that the time to rupture can be longer than shown in the figure.

<Tensile Strength Test>

For the test materials MM13, MM11 and T5, a tensile strength test was conducted at test temperatures of 700° C. and 800° C. The results of the test are shown in the graphs shown in FIGS. 2A and 2B. For MM11 and MM13, tubular test pieces similar to those used in the creep rupture test were used. Because hoop strength is important when test materials are used as materials for tubes, a gauge portion was provided in the hoop direction of a tubular test piece of 6.9 mm diameter×0.4 mm wall thickness (MM13) or of 8.5 mm diameter×0.5 mm wall thickness (MM11) and a hoop tensile strength test (a ring tensile test) was conducted. The length of the gauge portion was 2 mm and the width thereof was 1.5 mm. In T5, which is a rod-shaped material, a gauge portion of 6 mm diameter×30 mm length was provided and an axial tensile strength test was conducted. Since an oxide dispersion strengthened martensitic steel has an equiaxed grain micro-structure and almost does not have anisotropy in strength, it is possible to make a comparison between the results of the tensile strength test of MM13 and MM11 and the results of the tensile strength test of T5. In accordance with JIS Z2241, the strain rate was set at 0.1%/min to 0.7%/min.

Figure 2A:
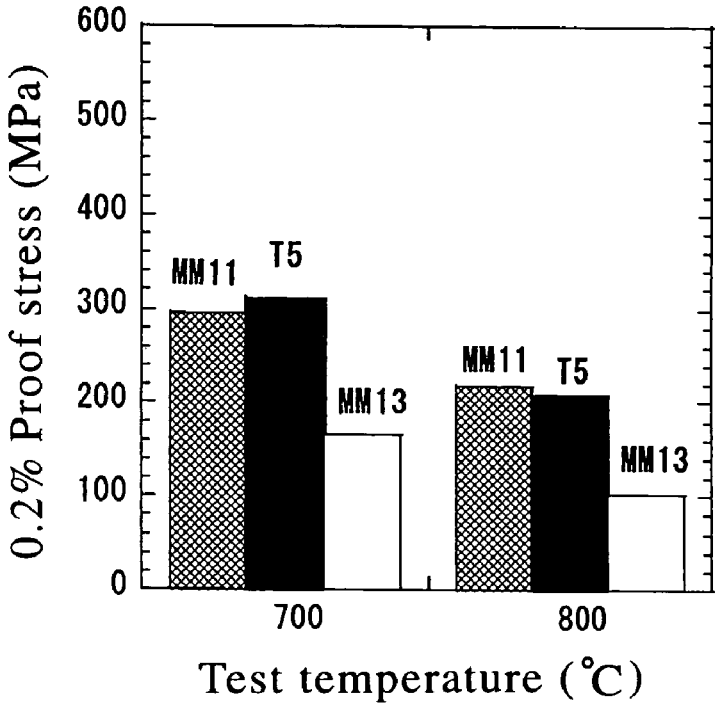
FIGS. 2A and 2B are graphs showing the results of a tensile test at 700° C. and 800° C. of the test materials MM11, T5 and MM13. The graph 2A shows 0.2% proof stress and the graph 2B shows tensile strength.
Figure 2B:
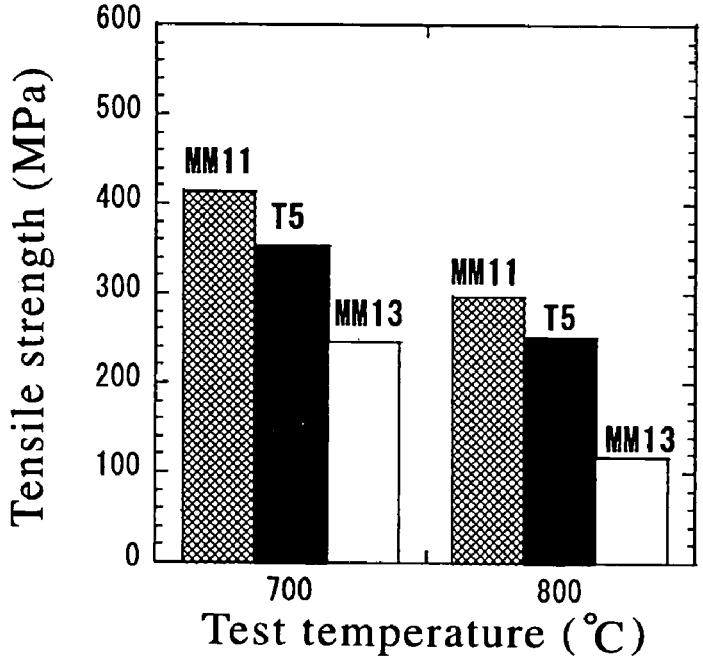

As is understood from the graphs shown in FIGS. 2A and 2B, the test materials MM11 and T5 are superior to the test material MM13 of the basic composition in both 0.2% proof stress and tensile strength.

<Microscopic Observation>

For each of the test materials prepared by subjecting the hot extruded rod-shaped materials obtained above to heat treatment for normalizing (1050° C.×1 hr), an observation by a transmission electron microscope (TEM) was carried out. The results of the microscopic observation are shown in FIG. 3 (test materials having an amount of added Ti of 0.2%) and in FIG. 4 (test materials having an amount of added Ti of 0.5%).

Figure 3:
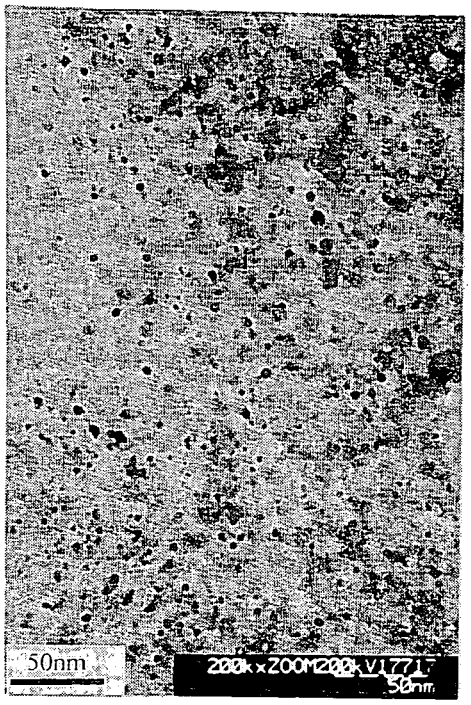
FIG. 3 is transmission electron microphotographs of the test materials MM11, T14, MM13 and T3 having an amount of added Ti of 0.2%.
Figure 3:
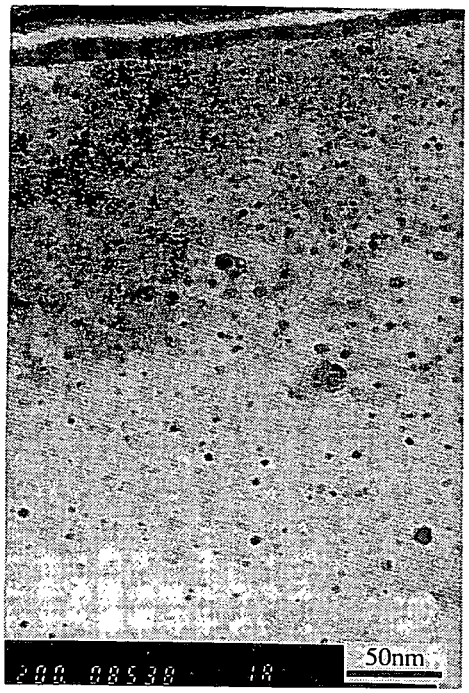
Figure 3:
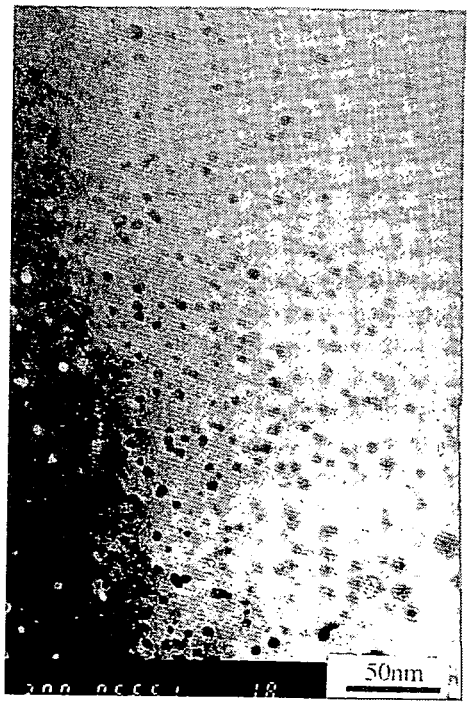
Figure 3:
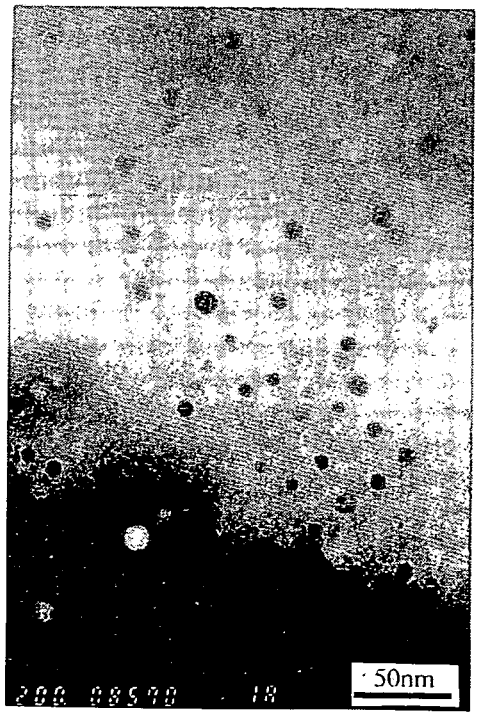
Figure 4:
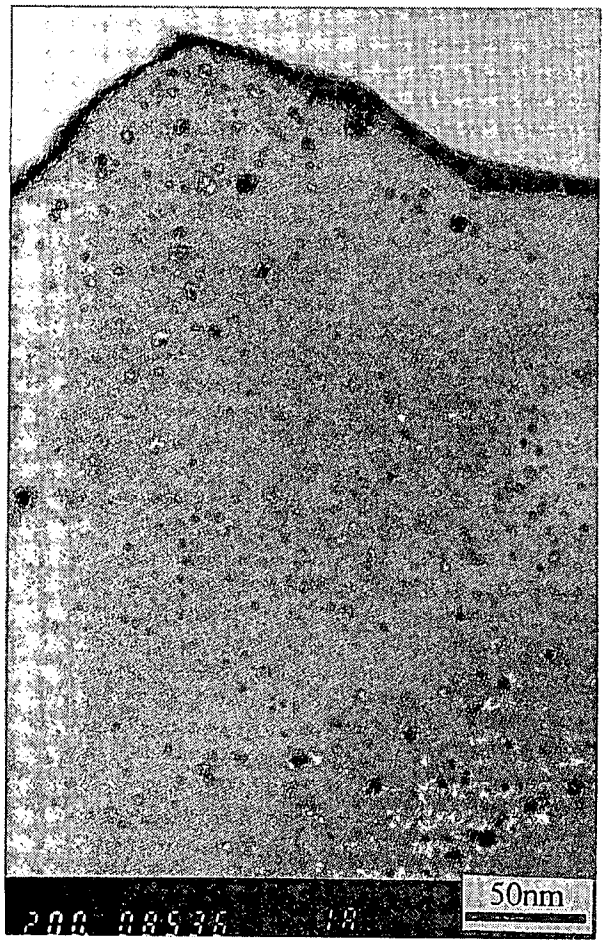
FIG. 4 is transmission electron microphotographs of the test materials T4 and T5 having an amount of added Ti of 0.5%.
Figure 4:
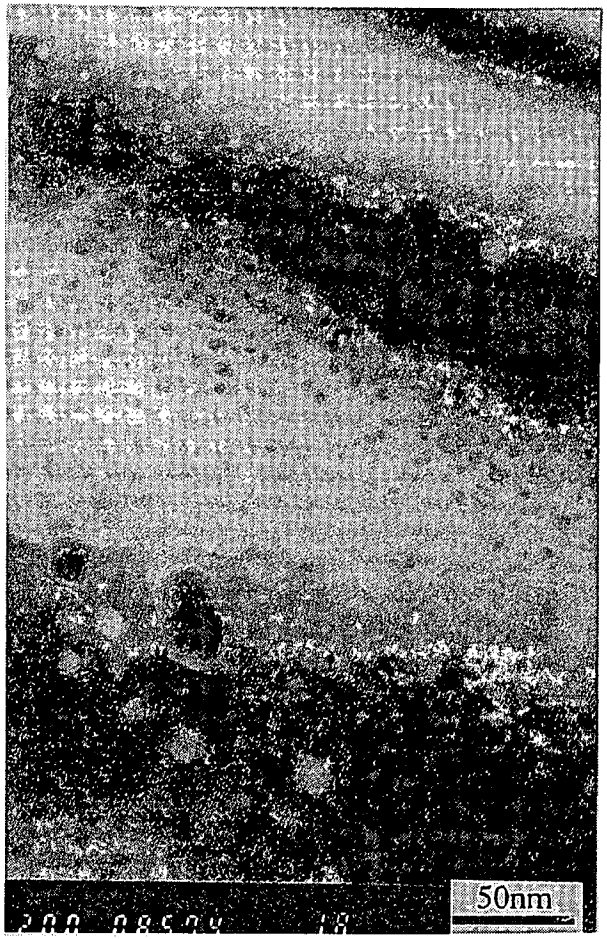

In FIG. 3, the test material MM11 shows $Y_2O_3$ particles which are more finely dispersed and more increased in density at a higher level than T14, MM13 and T3. In FIG. 4, both T4 and T5 show $Y_2O_3$ particles which are finely dispersed and increased in density.

<Ti Content and Excess Oxygen Content>

Figure 5:
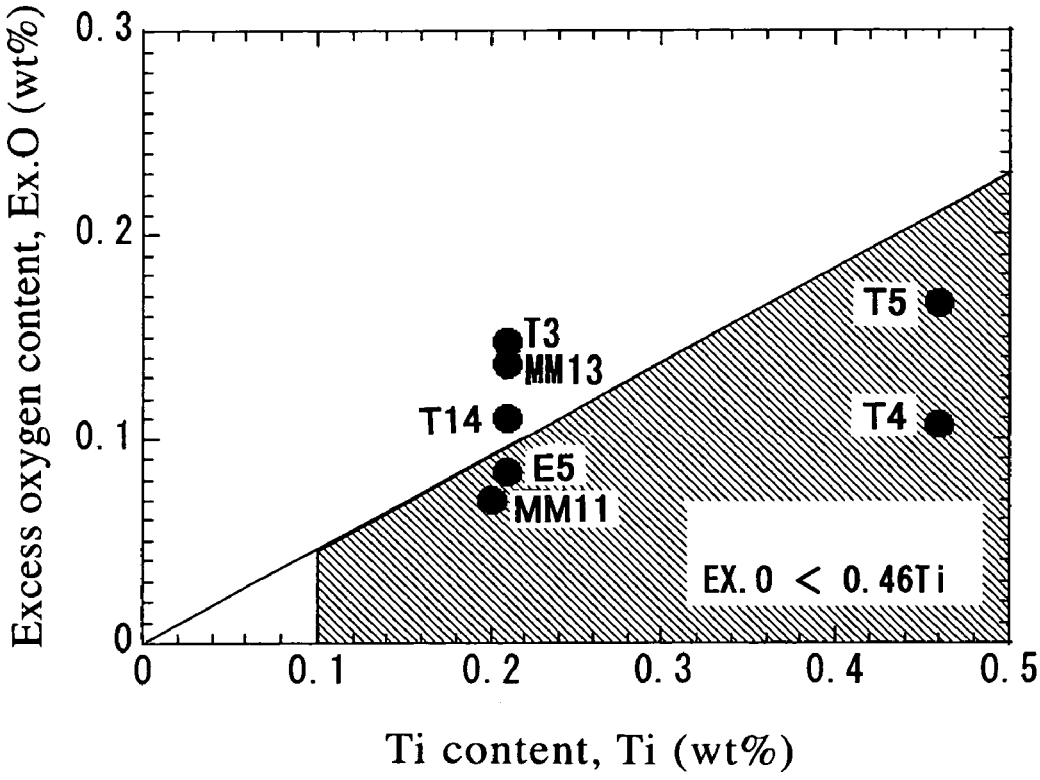
FIG. 5 is a graph showing the relationship between the Ti content and the excess oxygen content Ex.O of each test material. The diagonally shaded portion indicates an area in which oxide particles can be finely dispersed and [Ex.O<0.46×Ti] is satisfied.

For each of the test materials, the relationship between the Ti content and the excess oxygen content (Ex.O) shown in the results of chemical analysis in Table 2 are illustrated in the graph shown in FIG. 5. Each of the test materials MM11, T4, T5 and E5 included in the diagonally shaded portion of this graph is excellent in creep rupture strength and tensile strength and shows $Y_2O_3$ particles which are finely dispersed and highly densified. Namely, it is understood that at Ti contents of not less than 0.1%, test materials which satisfy the relationship of excess oxygen content (Ex.O)<0.46×Ti produce oxide dispersion strengthened martensitic steels in which $Y_2O_3$ particles are finely dispersed and highly densified and which are excellent in high-temperature strength.

Incidentally, in the graph shown FIG. 5, a lower limit of the excess oxygen content Ex.O expressed by [0.22×Ti (% by weight)<Ex.O (% by weight)] is not examined. The lower limit will be described referring to FIGS. 8 and 9, which will be described later.

<Adjustment of Ti Content>

A comparison between the test material MM13 of basic composition (Ti content: 0.21%, excess oxygen content 0.137>0.46×Ti) and the test material T4 in which the Ti content was increased (Ti content: 0.46%, excess oxygen content 0.107<0.46×Ti) reveals that T4 shows dispersed $Y_2O_3$ particles which are more finely dispersed and more increased in density at a higher level and has higher creep rupture strength.

In the test material T3 (Ti content: 0.21%, excess oxygen content 0.147>0.46×Ti) in which the excess oxygen content was intentionally increased by adding $Fe_2O_3$ to the test material MM13 of the basic composition, dispersed $Y_2O_3$ particles are more coarsened than the test material MM13 of the basic composition and creep rupture strength also decreases. However, by adding a further increased amount of Ti to the test material T3 in which the excess oxygen content was increased, it is possible to make the excess oxygen content less than 0.46×Ti % as seen in the test material T5 (Ti content: 0.46%, excess oxygen content 0.167<0.46×Ti), to more finely disperse and more highly densify dispersed $Y_2O_3$ particles at a higher level than T3, and to improve the creep rupture strength.

From these facts, it is understood that in the oxide dispersion strengthened martensitic steel in which the Ti content in steel is adjusted within the range of 0.1 to 0.5% so that the excess oxygen content becomes less than 0.46×Ti, $Y_2O_3$ particles are finely dispersed and highly densified and the high-temperature strength of this steel is excellent.

<Purity of Ar Gas>

Even in the test material E5 (excess oxygen content 0.084<0.46×Ti) having the same composition as the test material MM13 of the basic composition (excess oxygen content 0.137>0.46×Ti), by changing the purity of Ar gas used in the Ar atmosphere during mechanical alloying treatment from a high purity of 99.99% to a super high purity of 99.9999%, it is possible to reduce the oxygen contamination during the stirring in the attritor and hence the excess oxygen content in steel can be held to less than 0.46×Ti %.

From this fact, it is understood that by using a super high purity Ar gas of not less than 99.9999% as the Ar atmosphere during mechanical alloying treatment, it is possible to obtain an oxide dispersion strengthened martensitic steel in which $Y_2O_3$ particles are finely dispersed and highly densified and which is excellent in high-temperature strength.

<Adjustment of Stirring Energy During Mechanical Alloying Treatment>

A comparison between the test material MM13 of the basic composition (excess oxygen content 0.137>0.46×Ti) and the test material MM11 of the same composition (excess oxygen content 0.07<0.46×Ti) reveals that in the test material MM11 which was obtained by reducing stirring energy during mechanical alloying treatment by use of a pin attached to the agitator in the attritor having a length shorter than normal length, it is possible to hold the excess oxygen content to less than 0.46×Ti %.

In the test material MM11, $Y_2O_3$ particles can be finely dispersed and highly densified in comparison with the test material MM13 and creep rupture strength and tensile temperature strength can be improved.

From this fact, it is understood that by reducing the stirring energy during mechanical alloying treatment to limit the amount of entrapped oxygen during stirring, it is possible to obtain an oxide dispersion strengthened martensitic steel in which $Y_2O_3$ particles are finely dispersed and highly densified and which is excellent in high-temperature strength.

<Use of Metal Y Powder in Place of $Y_2O_3$ Powder>

Table 3 collectively shows the target compositions and the target excess oxygen contents of the test materials. Incidentally, E5 and T3 in Table 3 are the same as the test materials in Table 1.

E5 and E7 are standard materials of the basic composition to which a $Y_2O_3$ powder is added and the target excess oxygen content is 0.08%. Y1, Y2 and Y3 are materials to which a metal Y powder is added in place of a $Y_2O_3$ powder. That is, in Y1, a metal Y powder is added without the addition of an unstable oxide ($Fe_2O_3$) and the target excess oxygen content is 0%. In Y2 and Y3, a $Fe_2O_3$ powder, along with a metal Y powder, is added in an amount of 0.15% and 0.29%, respectively, and the target excess oxygen content is 0.05% and 0.09%, respectively. In T3, the excess oxygen content is increased by adding $Fe_2O_3$ powder to the basic composition of E5 and E7.

The test materials Y1, Y2, Y3 and E7 were all produced as hot extruded rod-shaped materials by the same manufacturing method and under the same manufacturing conditions as with MM13 described above, and heating and cooling in furnace (1050° C.×1 hr→600° C. (30° C./hr)) or normalizing (1050° C.×1 hr·air cooling)+tempering (780° C.×1 hr·air cooling) was carried out as final heat treatment.

The results of chemical analysis of each test material are collectively shown in Table 4.

TABLE 3

| Test material | Target composition | Feature |
|---|---|---|
| Y1 | 0.13C—9Cr—2W—0.2Ti—0.28Y | Target excess oxygen content: 0 wt % |
| Y2 | 0.13C—9Cr—2W—0.2Ti—0.28Y—0.15$Fe_2O_3$ | Target excess oxygen content: 0.05 wt % |
| Y3 | 0.13C—9Cr—2W—0.2Ti—0.28Y—0.29$Fe_2O_3$ | Target excess oxygen content: 0.09 wt % |
| E5, E7 | 0.13C—9Cr—2W—0.20Ti—0.35$Y_2O_3$ | Standard material (target excess oxygen content: 0.08 wt %) |
| T3 | 0.13C—9Cr—2W—0.20Ti—0.35$Y_2O_3$—0.17$Fe_2O_3$ | Excess oxygen added-material (target excess oxygen content: 0.13 wt %) |

TABLE 4

| | Chemical compositions (wt %) | | | | | | | | | | | | | | |
|---|---|---|---|---|---|---|---|---|---|---|---|---|---|---|---|
| | C | Si | Mn | P | S | Ni | Cr | W | Ti | Y | O | N | Ar | $Y_2O_3$ | Ex. O |
| Y1 | 0.13 | 0.012 | <0.01 | <0.005 | 0.002 | 0.01 | 8.85 | 1.93 | 0.20 | 0.27 | 0.099 | 0.014 | 0.0054 | 0.34 | 0.026 |
| Y2 | 0.13 | 0.005 | <0.01 | <0.005 | 0.002 | 0.01 | 8.87 | 1.96 | 0.21 | 0.28 | 0.12 | 0.012 | 0.0055 | 0.36 | 0.044 |
| Y3 | 0.14 | 0.020 | <0.01 | <0.005 | 0.002 | <0.01 | 8.86 | 1.97 | 0.21 | 0.28 | 0.18 | 0.010 | 0.0050 | 0.36 | 0.104 |
| E7 | 0.14 | 0.007 | 0.02 | <0.005 | 0.003 | 0.02 | 8.92 | 1.97 | 0.20 | 0.27 | 0.16 | 0.0099 | 0.0047 | 0.34 | 0.087 |
| E5 | 0.13 | <0.005 | <0.01 | <0.005 | 0.002 | 0.01 | 8.89 | 1.97 | 0.21 | 0.28 | 0.16 | 0.0087 | 0.0048 | 0.36 | 0.084 |
| T3 | 0.13 | <0.005 | <0.01 | 0.002 | 0.003 | 0.01 | 8.75 | 1.93 | 0.21 | 0.27 | 0.22 | 0.012 | 0.0049 | 0.34 | 0.147 |

Figure 6:
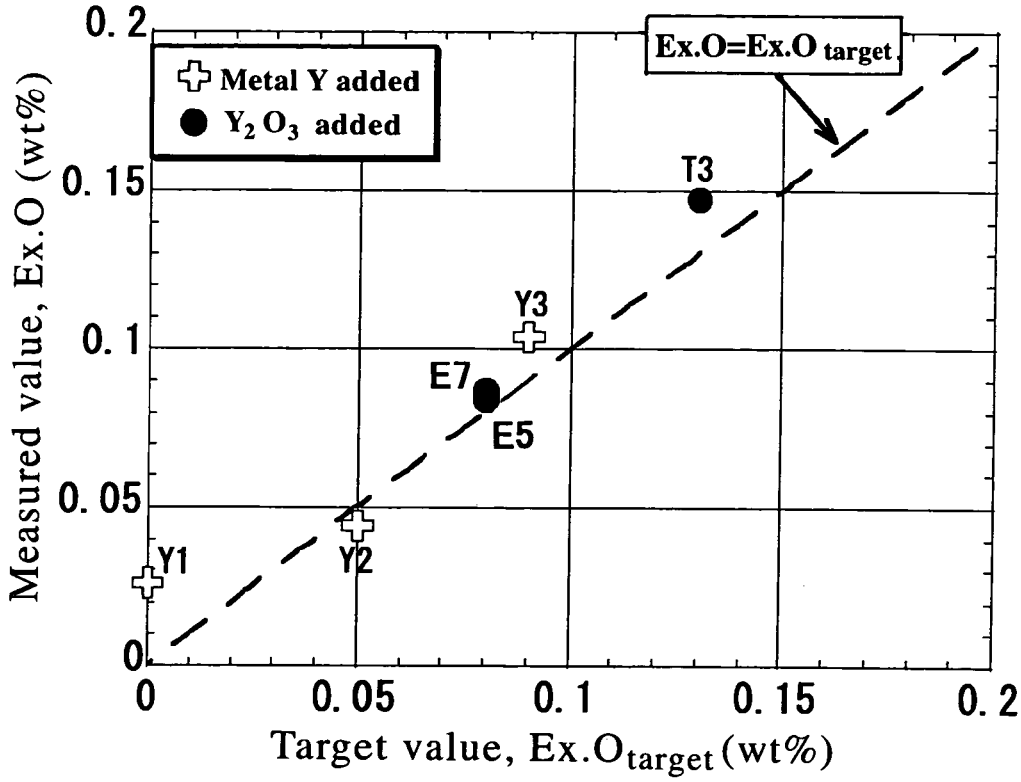
FIG. 6 is a graph showing the relationship between the measured value and target value of excess oxygen content of each test material.

FIG. 6 is a graph showing the relationship between the measured value and target value of excess oxygen content of each test material. The target oxygen content was set taking into consideration the oxygen contamination of about 0.04% from the raw material powders and about 0.04% during mechanical alloying treatment, that is, 0.08% in total, in addition to oxygen brought from the $Fe_2O_3$ power and $Y_2O_3$ powder. Incidentally, the impurity oxygen content in the raw material powders (Fe, Cr, W, Ti) and the content of oxygen inclusion during mechanical alloying treatment were determined by measuring the chemical compositions in the raw material powders and in alloys after mechanical alloying treatment, respectively, by an inert gas fusion method.

From FIG. 6, it is understood that even at low content of excess oxygen of not more than 0.1%, agreement is almost obtained between the target values and measured values of excess oxygen content and that $Y_2O_3$ is formed by the combined addition of metal Y and $Fe_2O_3$, with the result that the excess oxygen content can be controlled in a low range of not more than 0.1%.

Figure 7A:
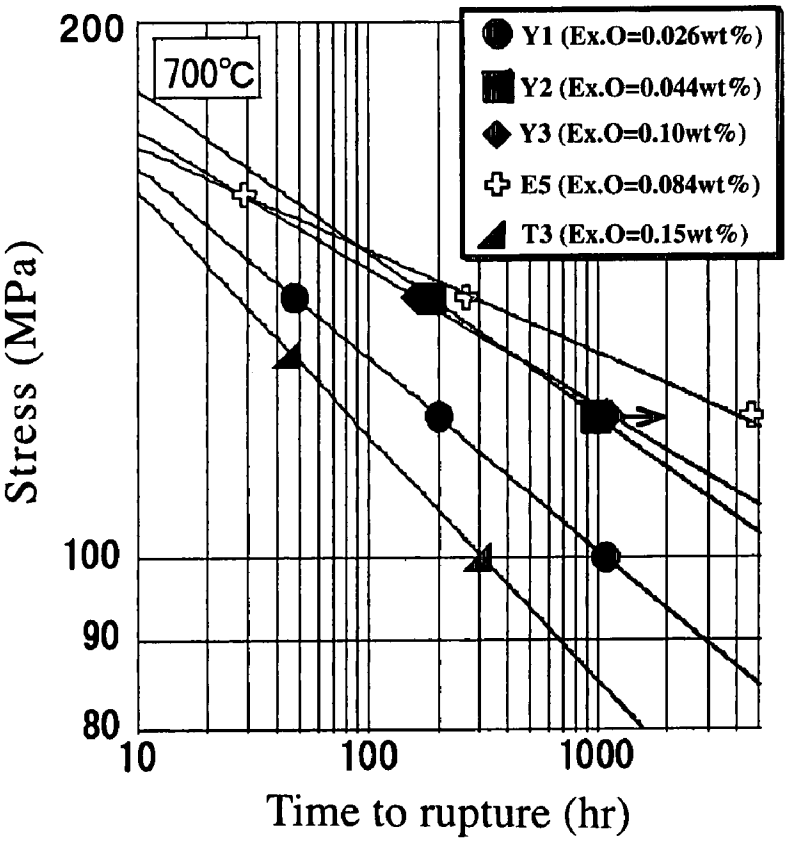
FIGS. 7A and 7B are graphs showing the results of a high-temperature creep rupture test at 700° C. of each test material. The graph 7A shows the results of the creep rupture test and the graph 7B shows the dependence of rupture stresses at 1000 hours on the excess oxygen content.
Figure 7B:
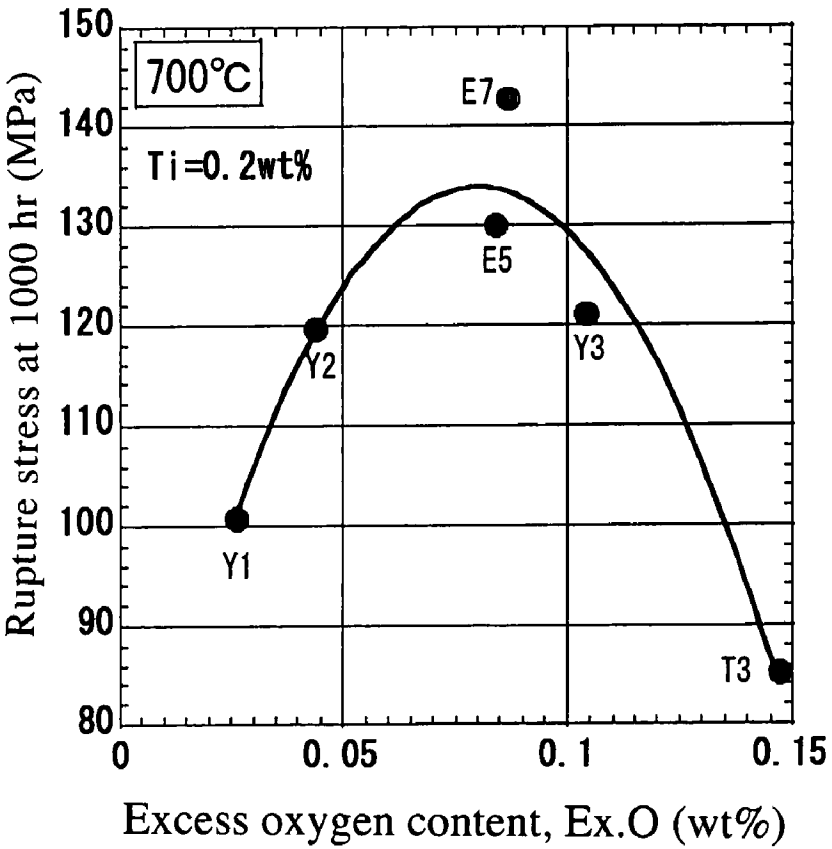

FIGS. 7A and 7B show the results of high-temperature creep test for each test material at 700° C. FIG. 7A is a graph showing the results of the creep rupture test and FIG. 7B is a graph showing the dependence of rupture stresses at 1000 hours on the excess oxygen content. In the test materials E5 and E7 having the excess oxygen content of about 0.08%, the high-temperature creep strength reaches a peak, and the strength tends to decrease at before and after 0.08%. From this fact, it is understood that the adjustment of the excess oxygen content at low levels of about 0.08% is effective in improving high-temperature strength and that it is effective to add a metal Y powder in place of a $Y_2O_3$ powder as control means of the excess oxygen content at such low levels. It is further understood that, since excessive lowering of the excess oxygen content results in a decrease in high-temperature strength, it is necessary to set not only an upper limit of the excess oxygen content, which is less than 0.46×Ti %, but also a lower limit of the excess oxygen content in steel.

Figure 8A:
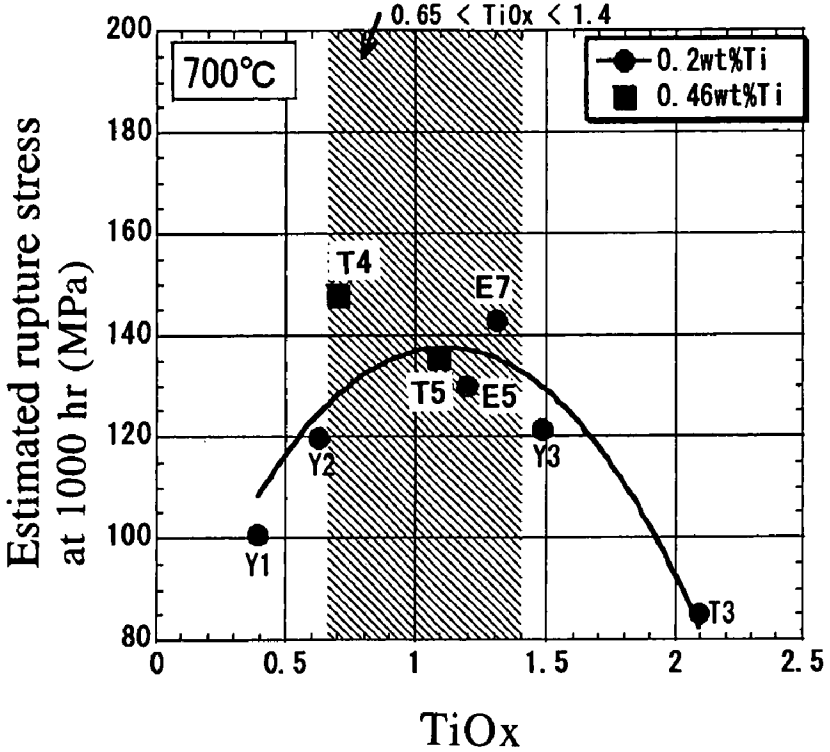
FIGS. 8A and 8B are graphs showing the dependence of the results of a high-temperature creep rupture test at 700° C. of each test material on TiOx (atomic percentage ratio of Ex.O/Ti) The graph 8A shows the dependence of estimated rupture stresses at 1000 hours on TiOx and the graph 8B shows the dependence of tensile strength on TiOx.
Figure 8B:
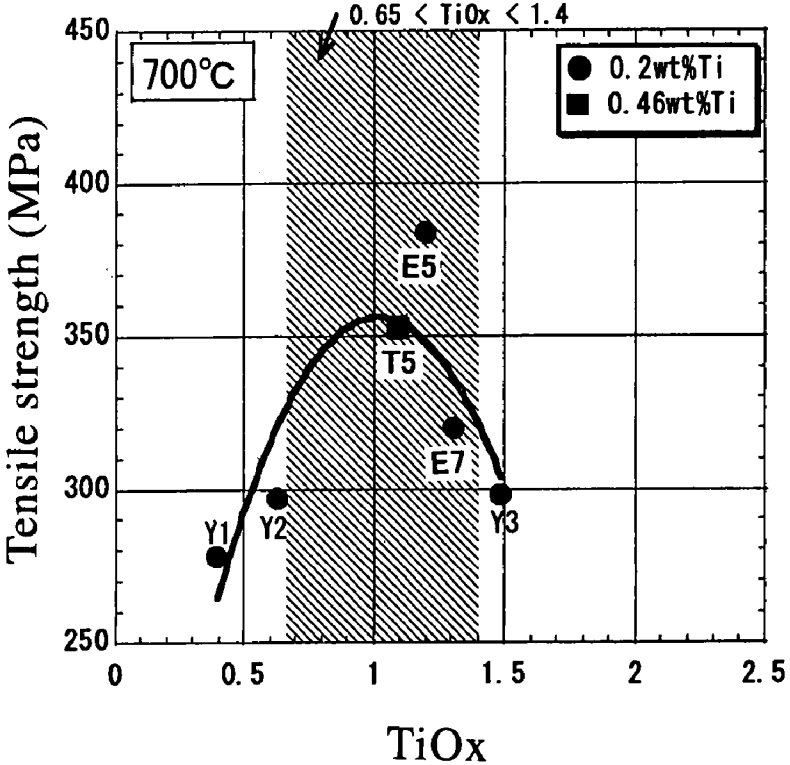

FIGS. 8A and 8B show the dependence of the results of a high-temperature creep test at 700° C. of each test material on TiOx (atomic percentage ratio of Ex.O/Ti). FIG. 8A is a graph showing the dependence of estimated rupture stresses at 1000 hours on TiOx and FIG. 8B is a graph showing the dependence of tensile strength on TiOx. From these graphs, it is understood that the creep strength and tensile strength reach a peak in the TiOx range of 0.65 to 1.4 (diagonally shaded portion).

Figure 9:
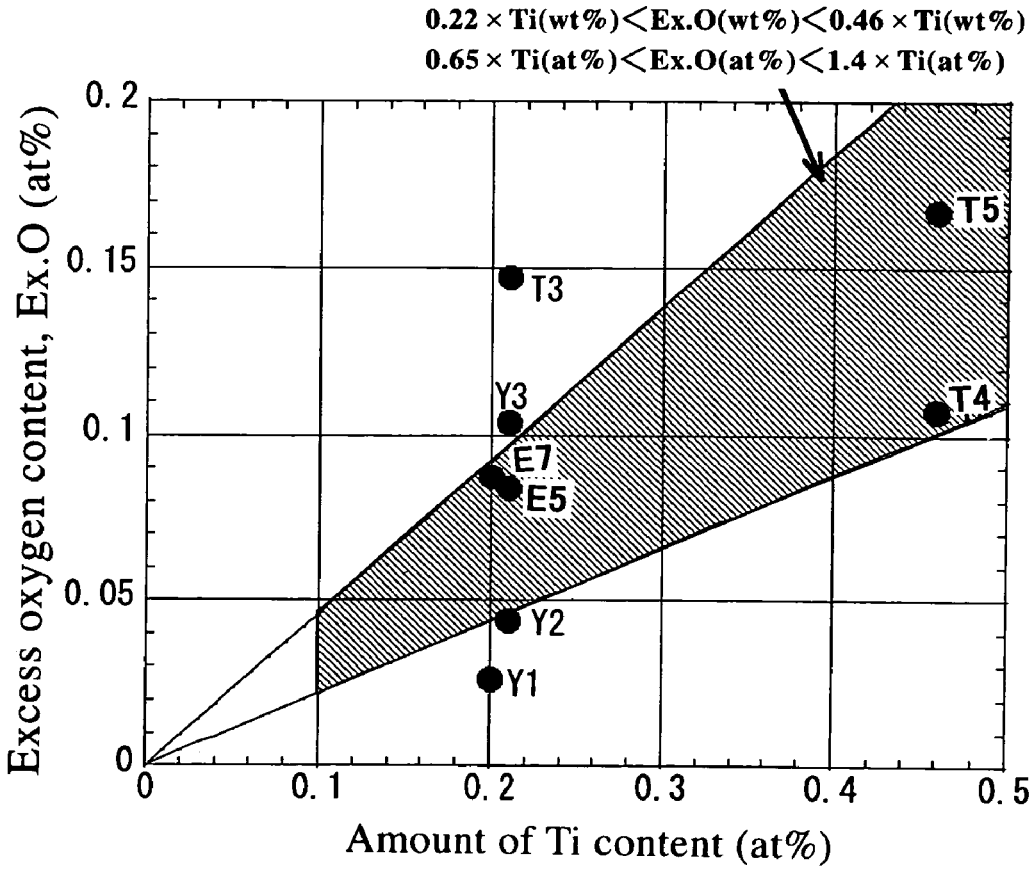
FIG. 9 is a graph showing the relationship between the amount of Ti content and excess oxygen content Ex.O of each test material.

FIG. 9 is a graph showing the relationship between the amount of added Ti and excess oxygen content Ex.O of each test material, and the range showing the peak of creep strength in FIG. 8, namely [0.65×Ti (atomic %)<Ex.O (atomic %)<1.4×Ti (atomic %)], is indicated by oblique lines. When the above-described relationship expressed by atomic % is converted to % by weight, there can be described as follows: [0.22×Ti (% by weight)<Ex.O (% by weight)<0.464×Ti (% by weight)].

As described above, Ti forms complex oxides by reacting with a $Y_2O_3$ powder, thereby functioning to finely disperse oxide particles. This action tends to reach a level of saturation when the Ti content exceeds 1.0%, and becomes small when the Ti content is less than 0.1%. From this fact, when the amount of added Ti is in the range of 0.1% to 1.0%, by controlling the excess oxygen content within the range of [0.22×Ti (% by weight)<Ex.0 (% by weight)<0.464×Ti (% by weight)], namely, within the diagonally shaded range in the graph of FIG. 9, it is possible to manufacture an oxide dispersion strengthened martensitic steel excellent in high-temperature strength.

INDUSTRIAL APPLICABILITY

As is apparent from the above descriptions, according to the present invention, by paying attention to the excess oxygen content in steel, it is possible to positively obtain a structure in which oxide particles are finely dispersed and highly densified by adjusting the Ti content or by reducing the amount of oxygen contamination during the manufacturing process so that the excess oxygen content becomes within a predetermined range. As a result, it is possible to provide an oxide dispersion strengthened martensitic steel excellent in high-temperature strength.

What is claimed is:

1. A method of manufacturing an oxide dispersion strengthened martensitic steel excellent in high-temperature strength, said method comprising mixing either element powders or alloy powders and a $Y_2O_3$ powder, subjecting the resulting powder mixture to mechanical alloying treatment in an Ar atmosphere, subjecting the resulting alloyed powder to hot extrusion to solidify the alloyed powder, and subjecting the resulting solidified material to final heat treatment involving normalizing and tempering to manufacture an oxide dispersion strengthened martensitic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, wherein the oxide particles are finely dispersed and highly densified by adjusting the Ti content within the range of 0.1 to 1.0% so that an excess oxygen content Ex.O in the steel satisfies 0.22×Ti (% by weight)<Ex.O (% by weight)<0.46×Ti (% by weight), and the excess oxygen content Ex.O being a value obtained by subtracting an oxygen content in $Y_2O_3$ from an oxygen content in the steel.

2. A method of manufacturing an oxide dispersion strengthened martensitic steel excellent in high-temperature strength, said method comprising mixing either element powders or alloy powders and a $Y_2O_3$ powder, subjecting the resulting powder mixture to mechanical alloying treatment in an Ar atmosphere, subjecting the resulting alloyed powder to hot extrusion to solidify the alloyed powder, and subjecting the resulting solidified material to final heat treatment involving normalizing and tempering to manufacture an oxide dispersion strengthened martensitic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, wherein an Ar gas having a purity of not less than 99.9999% is used as the Ar atmosphere so that an excess oxygen content Ex.O in the steel satisfies 0.22×Ti (% by weight)<Ex.O(% by weight)<0.46×Ti (% by weight) the excess oxygen content Ex.O being a value obtained by subtracting an oxygen content in $Y_2O_3$ from an oxygen content in the steel.

3. A method of manufacturing an oxide dispersion strengthened martensitic steel excellent in high-temperature strength, said method comprising mixing either element powders or alloy powders and a $Y_2O_3$ powder, subjecting the resulting powder mixture to mechanical alloying treatment in an Ar atmosphere, subjecting the resulting alloyed powder to hot extrusion to solidify the alloyed powder, and subjecting the resulting solidified material to final heat treatment involving normalizing and tempering to manufacture an oxide dispersion strengthened martensitic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, wherein a stirring energy during the mechanical alloying treatment decreases to suppress oxygen contamination during stirring so that an excess oxygen content Ex.O in the steel satisfies, 0.22×Ti (% by weight)<Ex.O (% by weight)<0.46×Ti (% by weight), and the excess oxygen content Ex.O being a value obtained by subtracting an oxygen content in $Y_2O_3$ from an oxygen content in the steel.

4. A method of manufacturing an oxide dispersion strengthened martensitic steel excellent in high-temperature strength, said method comprising mixing either element powders or alloy powders and a $Y_2O_3$ powder, subjecting the resulting powder mixture to mechanical alloying treatment in an Ar atmosphere, subjecting the resulting alloyed powder to hot extrusion to solidify the alloyed powder, and subjecting the resulting solidified material to final heat treatment involving normalizing and tempering to manufacture an oxide dispersion strengthened martensitic steel which comprises, as expressed by % by weight, 0.05 to 0.25% C, 8.0 to 12.0% Cr, 0.1 to 4.0% W, 0.1 to 1.0% Ti, 0.1 to 0.5% $Y_2O_3$ with the balance being Fe and unavoidable impurities and in which $Y_2O_3$ particles are dispersed in the steel, wherein a metal Y powder or a $Fe_2Y$ powder is used in place of the $Y_2O_3$ powder so that an excess oxygen content Ex.O in the steel satisfies, 0.22 ×Ti (% by weight)<Ex.O(% by weight)<0.46×Ti (% by weight) the excess oxygen content Ex.O being a value obtained by subtracting an oxygen content in $Y_2O_3$ from an oxygen content in the steel.

5. A method of manufacturing an oxide dispersion strengthened martensitic steel excellent in high-temperature strength, said method comprising mixing either element powders or alloy powders and a $Y_2O_3$ powder, subjecting the resulting powder mixture to mechanical alloying treatment in an Ar atmosphere, subjecting the resulting alloyed powder to hot extrusion to solidify the alloyed powder, and subjecting the resulting solidified material to final heat treatment involving normalizing and tempering to manufacture an oxide dispersion strengthened martensitic steel which comprises, as expressed by % by weight, 0.05 to 0.25% C, 8.0 to 12.0% Cr, 0.1 to 4.0% W, 0.1 to 1.0% Ti, 0.34 to 0.5% $Y_2O_3$ with the balance being Fe and unavoidable impurities and in which $Y_2O_3$ particles are dispersed in the steel, wherein the oxide particles are finely dispersed and highly densified by adjusting the Ti content within the range of 0.1 to 1.0% so that an excess oxygen content Ex.O in the steel satisfies, 0.22×Ti (% by weight)<Ex.O(% by weight)<0.46×Ti (% by weight) the excess oxygen content Ex.O being a value obtained by subtracting an oxygen content in $Y_2O_3$ from an oxygen content in the steel.

* * * * *